US009662534B1

(12) United States Patent
Liu

(10) Patent No.: US 9,662,534 B1
(45) Date of Patent: May 30, 2017

(54) PULL EXERCISE TRAINING DEVICE

(71) Applicant: CHI HUA FITNESS CO., LTD., Hsinchu County (TW)

(72) Inventor: Yuan-Pin Liu, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 0 days.

(21) Appl. No.: 15/136,057

(22) Filed: Apr. 22, 2016

(51) Int. Cl.

| | |
|---|---|
| ***A63B 22/06*** | (2006.01) |
| ***A63B 22/00*** | (2006.01) |
| ***A63B 24/00*** | (2006.01) |
| ***A63B 21/005*** | (2006.01) |
| ***A63B 21/008*** | (2006.01) |
| ***A63B 21/00*** | (2006.01) |
| ***A63B 23/12*** | (2006.01) |

(52) U.S. Cl.
CPC ..... *A63B 22/0076* (2013.01); *A63B 21/008* (2013.01); *A63B 21/0056* (2013.01); *A63B 21/153* (2013.01); *A63B 21/154* (2013.01); *A63B 21/157* (2013.01); *A63B 21/4035* (2015.10); *A63B 23/12* (2013.01); *A63B 24/0087* (2013.01); *A63B 2022/0079* (2013.01); *A63B 2024/009* (2013.01)

(58) Field of Classification Search
USPC ..... 482/1–148
See application file for complete search history.

(56) References Cited

U.S. PATENT DOCUMENTS

| | | | | |
|---|---|---|---|---|
| 4,875,674 | A * | 10/1989 | Dreissigacker | A63B 21/153 482/72 |
| 4,880,224 | A * | 11/1989 | Jonas | A63B 21/153 482/72 |
| 5,916,069 | A * | 6/1999 | Wang | A63B 21/153 482/57 |
| 6,328,677 | B1 * | 12/2001 | Drapeau | A63B 22/0076 482/55 |
| 7,591,766 | B2 * | 9/2009 | Ellis | A63B 21/153 482/72 |
| 8,070,657 | B2 * | 12/2011 | Loach | A63B 21/15 482/127 |
| 8,932,185 | B2 * | 1/2015 | Hsieh | H02K 21/025 188/164 |
| 2006/0148622 | A1 * | 7/2006 | Chen | A63B 21/153 482/72 |
| 2009/0093350 | A1 * | 4/2009 | Jahns | A63B 21/0004 482/110 |
| 2014/0113779 | A1 * | 4/2014 | Loach | A63B 21/0004 482/115 |

* cited by examiner

*Primary Examiner* — Stephen Crow
(74) *Attorney, Agent, or Firm* — Rosenberg, Klein & Lee

(57) ABSTRACT

A pull exercise training device has a frame body, a reel including a shaft, a rolling wheel, a driver pulley wheel and at least one mainspring, a band connected to the rolling wheel with an end, a load force device including a first axle through a flywheel and a driven pulley wheel, a one way clutch disposed between the first axle and the flywheel, a belt winding around the driver pulley wheel and the driven pulley wheel, a generator set, and a control circuit having a controller electrically connected to a resistor, an armature, and an interface for operation.

7 Claims, 6 Drawing Sheets

PULL EXERCISE TRAINING DEVICE

BACKGROUND OF THE INVENTION

1. Field of the Invention

The present invention relates to a pull exercise training device, particularly to one that provides multiple load forces from wind energy, inertia and magnetic resistance.

2. Description of the Related Art

Rowing machines for pull exercise training usually have a flywheel for producing inertia resistance, a fan wheel for producing wind resistance, or a pneumatic rod for pressure resistance as a load force. However, load forces produced by different structures provide different experiences for its user, and a rowing machine normally only has one single source of load force; plus, its user cannot set up or adjust the load force for different level of training.

SUMMARY OF THE INVENTION

A primary object of the present invention is to provide a pull exercise training device that provides load force by multiple sources of resistance.

Another object of the present invention is to provide a pull exercise device that can adjust the load force by its user for different level of training.

To achieve the objects mentioned above, the present invention comprises a frame body; a reel including a shaft engaging the frame body with a rolling wheel arranged therethrough, a driver pulley wheel, and at least one mainspring; a band connecting to the rolling wheel with an end thereof and to a pull bar with the other end thereof; a load force device including a first axle engaging the frame body with a flywheel and a driven pulley wheel arranged therethrough; a one way clutch disposed between the first axle and the flywheel; a belt winding around the driver pulley wheel and the driven pulley wheel; a generator set including a plurality of magnets disposed along an inner surface of a hub of the flywheel and an armature engaging a holder to be disposed in correspondence to the magnets; and a control circuit including a controller and a resistor disposed in the frame body, said controller electrically connected to the armature for stable power supply, to the resistor for control of electric currents, and to an interface for setting and adjusting by a user.

Furthermore, the flywheel includes a plurality of blades. A second axle is further engaging through a guiding wheel then fixed to the frame body for the band to wind around. The shaft engages the frame body, fixed by a pair of first bearings and a pair of first bearing caps. The second axle engages through the guiding wheel and is fixed by a pair of second bearings. The first axle is fixed to the holder by a pair of third bearings and a second bearing cap. The frame body further includes a protective cover for the mainspring and a bar latch for the pull bar to be positioned. In addition, a tensioner is arranged for the belt to wind around, engaging a positioning piece and a positioning element by a fourth bearing to be fixed to the frame body.

With structures disclosed above, the present invention is able to provide inertia resistance by the flywheel, and the blades on the flywheel further provide a load force by wind resistance; also, the armature provides a magnetic resistance as the load force which can be adjusted. Therefore the present invention is able to provide load forces from multiple sources of resistance.

DETAILED DESCRIPTION OF THE PREFERRED EMBODIMENT

Figure 1:
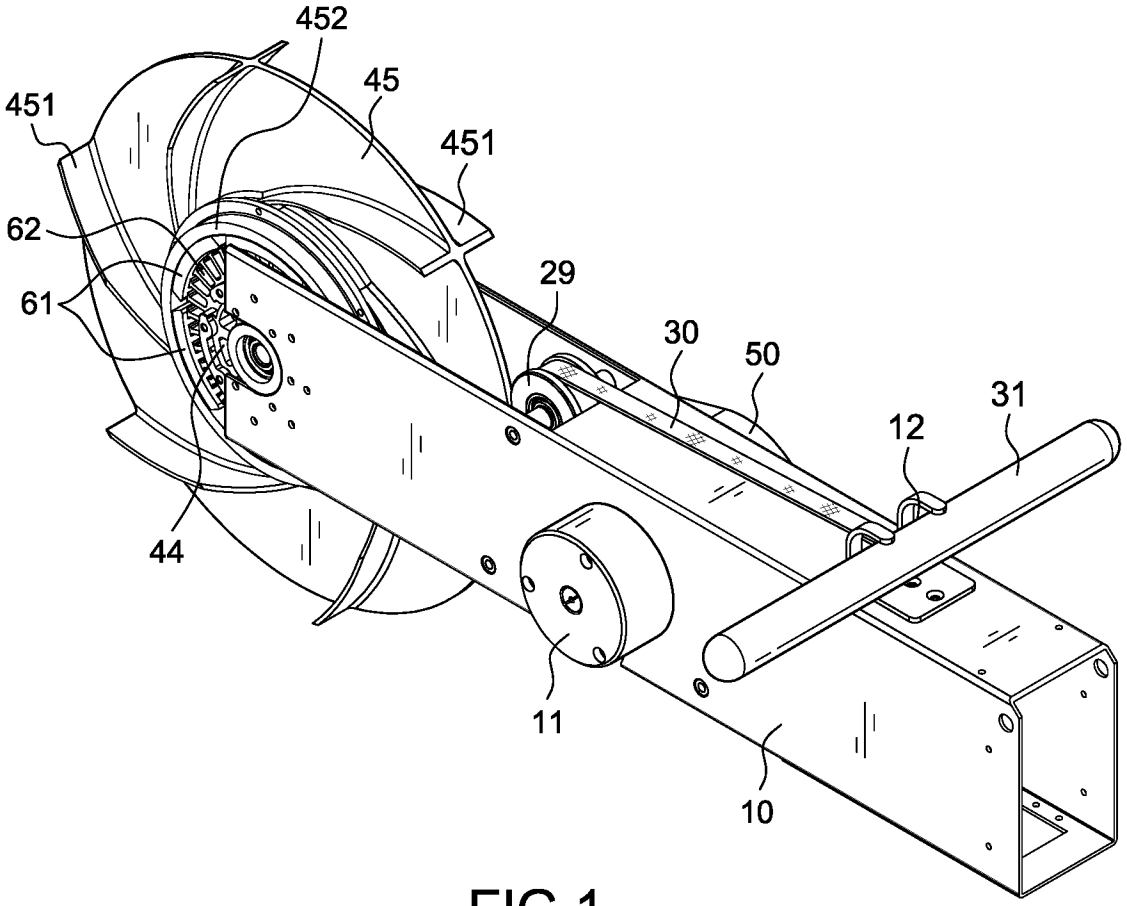
FIG. 1 is a perspective view of the present invention.
Figure 2:
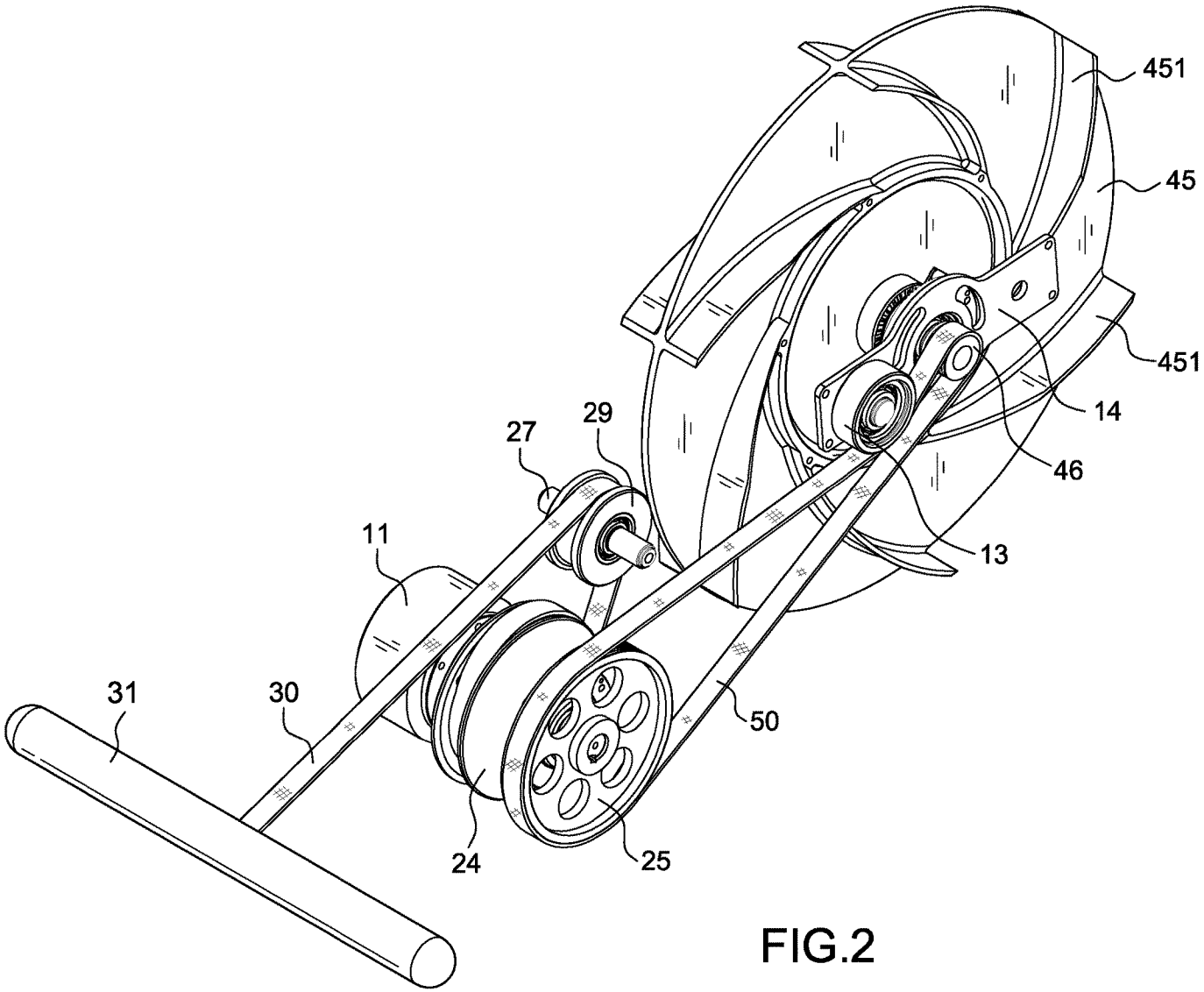
FIG. 2 is a schematic diagram illustrating structure of the present invention.
Figure 3:
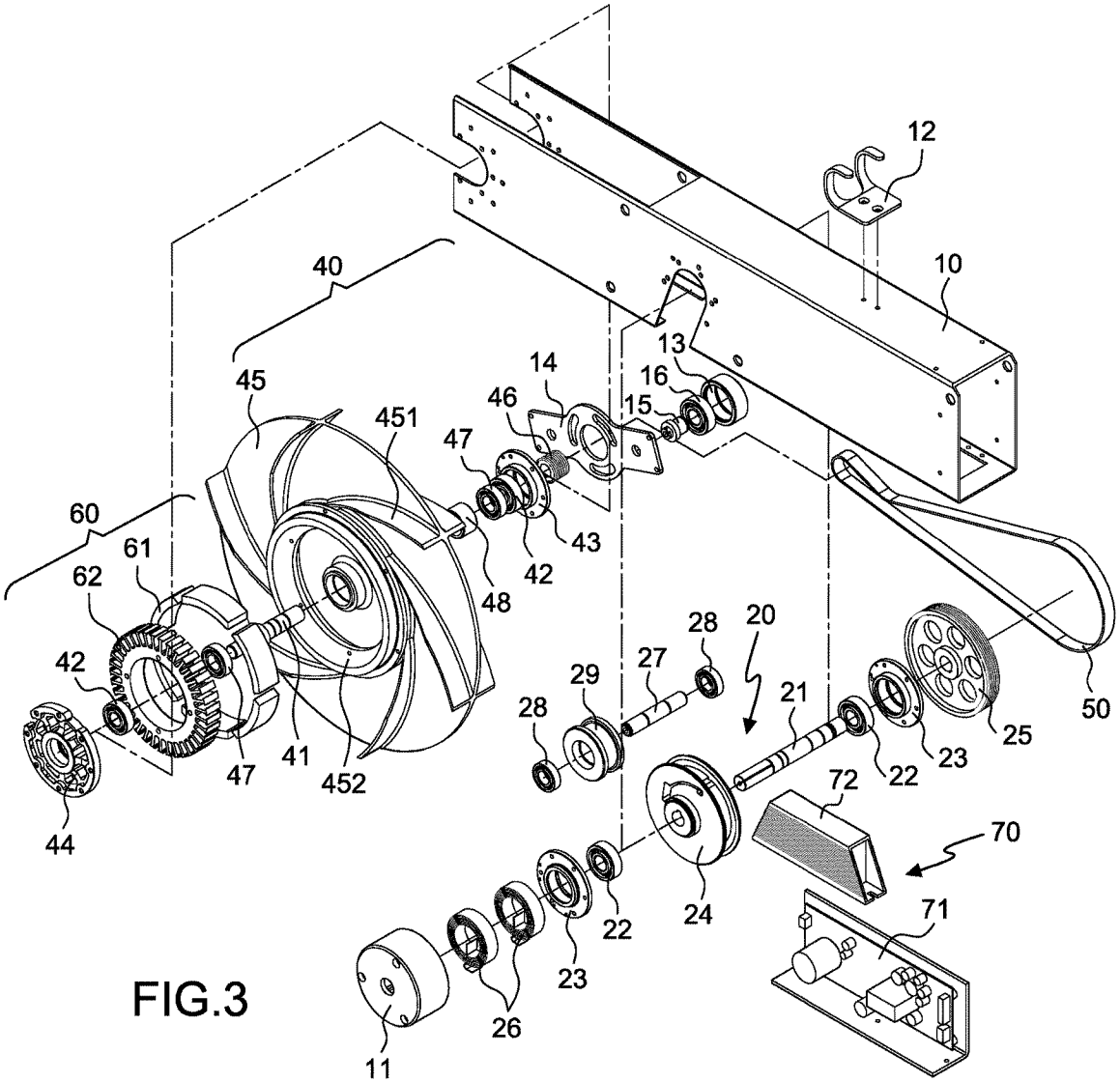
FIG. 3 is an exploded view of the present invention.
Figure 4:
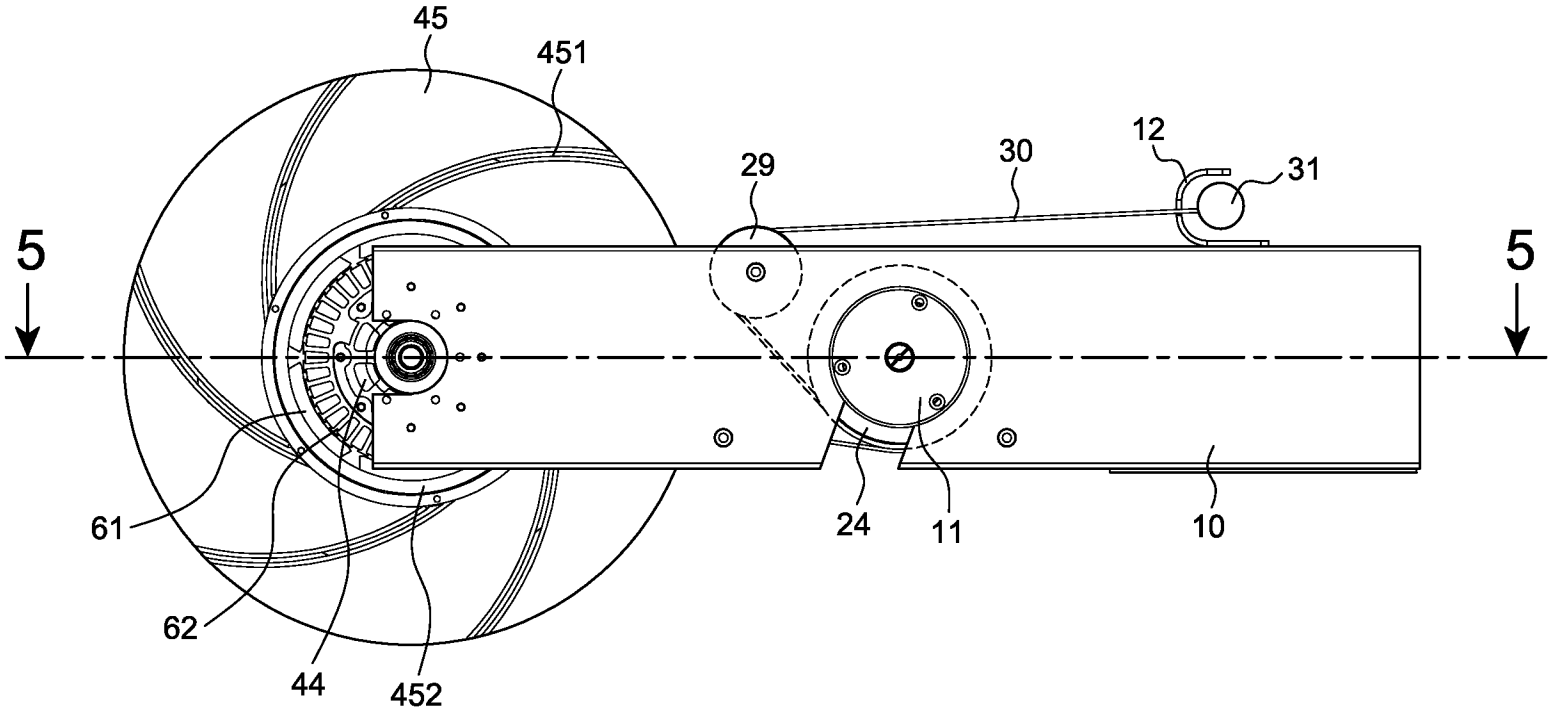
FIG. 4 is a side elevation view of the present invention.
Figure 5:
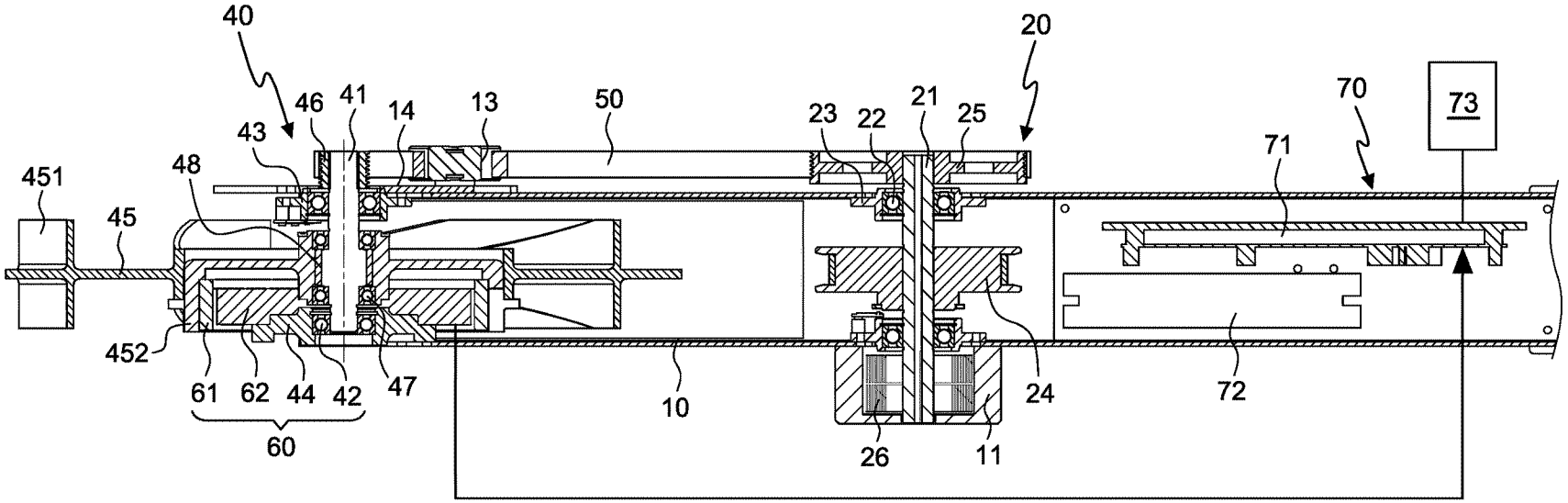
FIG. 5 is a sectional view along line 5-5 in FIG. 4.

Referring to FIGS. 1-5, in a preferred embodiment, the present invention comprises a frame body 10, a reel 20, a band 30, a load force device 40, a one way clutch 48, a belt 50, a generator set 60, and a control circuit 70.

The reel 20 has a shaft 21 engaging the frame body 10 by a pair of first bearings 22 and a pair of first bearing caps 23, a rolling wheel 24 arranged through the shaft 21 together with a driver pulley wheel 25 and at least one mainspring 26. In this embodiment, the frame body 10 further includes a protective cover 11 for the mainspring 26 to be covered, and a second axle 27 is further engaging through a guiding wheel 29 then fixed to the frame body 10 by a pair of second bearings 28 for the band 30 to wind around.

The band 30 is connecting to the rolling wheel 24 with an end thereof and to a pull bar 31 with the other end thereof to wind around the guiding wheel 29, and the frame body 10 further includes a bar latch 12 for the pull bar 31 to be positioned.

The load force device 40 includes a first axle 41 fixed to a holder 44 by a pair of third bearings 42 and a second bearing cap 43 to engage the frame body 10; the first axle 41 further engages through a flywheel 45 and a driven pulley wheel 46. The flywheel 45 includes a plurality of blades 451 and is fixed by a pair of fifth bearings 47.

The one way clutch 48 is disposed between the first axle 41 and the flywheel 45. The belt 50 winds around the driver pulley wheel 25 and the driven pulley wheel 46. In this embodiment, the frame body 10 further has a tensioner 13 for the belt 50 to wind around. The tensioner 13 further engages a positioning piece 14 and a positioning element 15 by a fourth bearing 16 to be fixed to the frame body 10.

The generator set 60 includes a plurality of magnets 61 disposed along an inner surface of a hub 452 of the flywheel 45 and an armature 62 arranged correspondingly to the magnets 61. The control circuit 70 includes a controller 71 and a resistor 72 disposed in the frame body 10. The controller 71 is electrically connected to the armature 62 for stable power supply, to the resistor 72 for control of electric currents, and to an interface 73 for setting and adjusting by a user.

Figure 6:
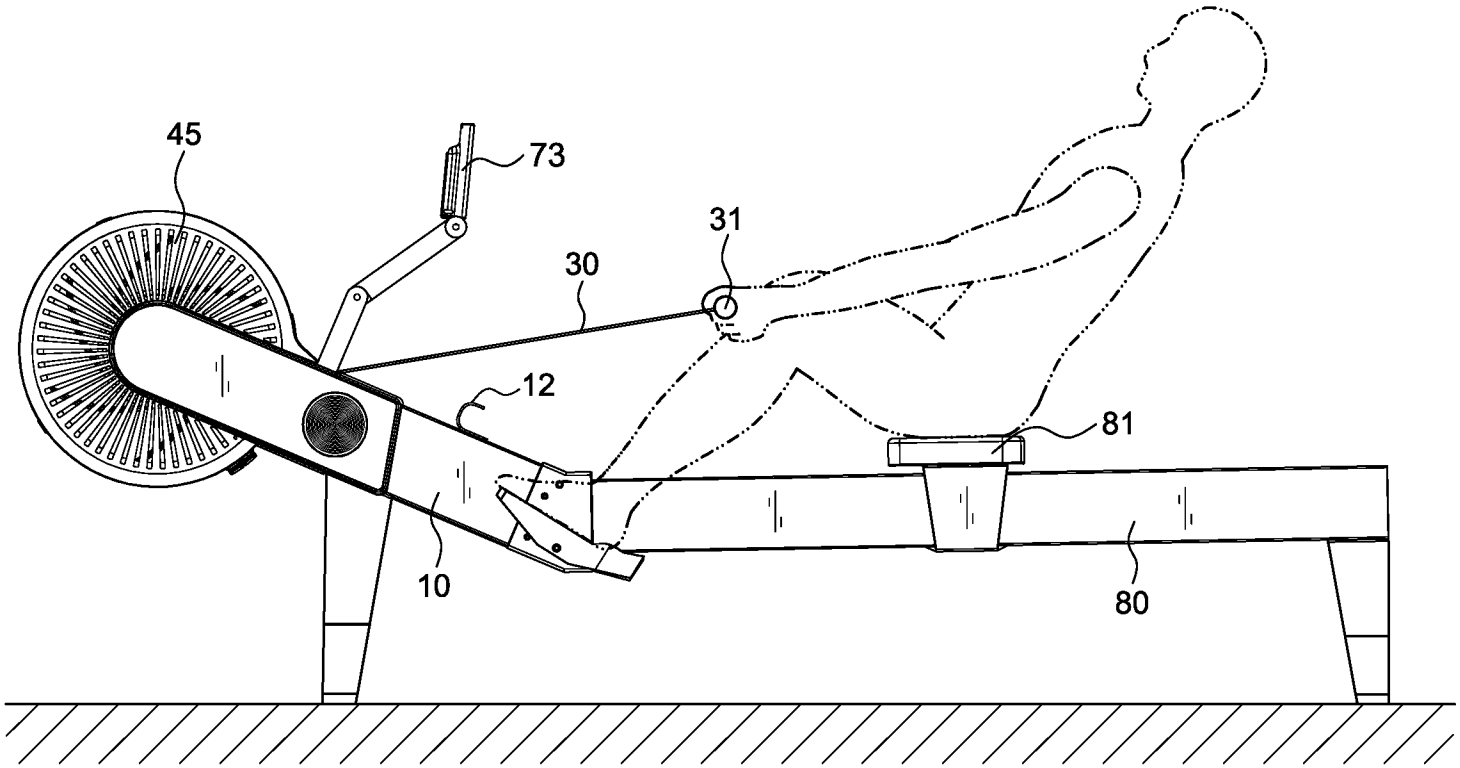
FIG. 6 is a practical application view of the present invention.

Further referring to FIG. 6, the present invention can be applied to simulate the practice of rowing with engagement with a base frame 80 with a seat pad 81. When a user pulls the pull bar 31 backwards, the band 30 is pulled out from the rolling wheel 24, driving the shaft 21 and then the driver pulley wheel 25 for the mainspring 26 to produce the spring power. The driver pulley wheel 25 then drives the driven pulley wheel 46 by the belt 50, therefore rolling the flywheel 45 by the first axle 41 and rolling the armature 62. The present invention thereby provides multiple resistances of inertia and wind resistance by the flywheel 45 and magnetic resistance by the armature 62. The magnetic resistance can also be adjusted via the interface 73 depending on the electric currents going through the resistor 72. When the user stops pulling, the mainspring 26 would release the spring power and roll back the shaft 21 and rolling wheel 24, rolling back the band 30; while the flywheel 45 would remain it rolling direction without rolling back due to the design of the one way clutch 48.

In short, the present invention is able to provide load force from different resistances of inertia, wind, and magnets with the structure of flywheel 45, the blades 451 of the flywheel 45, and the armature 62. Besides, the magnetic resistance is adjustable for its user to be trained with a suitable level of load force for pull exercise.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pull exercise training device, comprising:

a frame body;

a reel including a shaft engaging the frame body with a rolling wheel arranged therethrough, a driver pulley wheel, and at least one mainspring;

a band connecting to the rolling wheel with an end thereof and to a pull bar with the other end thereof;

a load force device including a first axle engaging the frame body with a flywheel and a driven pulley wheel arranged therethrough;

a one way clutch disposed between the first axle and the flywheel;

a belt winding around the driver pulley wheel and the driven pulley wheel;

a generator set including a plurality of magnets disposed along an inner surface of a hub of the flywheel and an armature engaging a holder to be disposed in correspondence to the magnets; and a control circuit including a controller and a resistor disposed in the frame body, said controller electrically connected to the armature for stable power supply, to the resistor for control of electric currents, and to an interface for setting and adjusting by a user.

2. The pull exercise training device as claimed in claim 1, wherein the flywheel includes a plurality of blades.

3. The pull exercise training device as claimed in claim 2, wherein a second axle is further engaging through a guiding wheel then fixed to the frame body for the band to wind around.

4. The pull exercise training device as claimed in claim 2, wherein the shaft engages the frame body, fixed by a pair of first bearings and a pair of first bearing caps; the second axle engages through the guiding wheel and is fixed by a pair of second bearings; the first axle is fixed to the holder by a pair of third bearings and a second bearing cap.

5. The pull exercise training device as claimed in claim 2, wherein the frame body further includes a protective cover for the mainspring and a bar latch for the pull bar to be positioned.

6. The pull exercise training device as claimed in claim 2, wherein a tensioner is arranged for the belt to wind around.

7. The pull exercise training device as claimed in claim 6, wherein the tensioner further engages a positioning piece and a positioning element by a fourth bearing to be fixed to the frame body.

* * * * *